US005555958A

United States Patent [19]

Staggl et al.

[11] Patent Number: 5,555,958

[45] Date of Patent: Sep. 17, 1996

[54] SUPPORTING AND GUIDING ARRANGEMENT, IN PARTICULAR A POST FOR SHELF STORAGE AND RETRIEVAL DEVICES

[75] Inventors: Roland Staggl, Wetter; Jörg Oser, Graz, both of Germany

[73] Assignee: Mannesmann Aktiengesellschaft, Dusseldorf, Germany

[21] Appl. No.: 398,896

[22] Filed: Mar. 6, 1995

[51] Int. Cl.[6] ..... B66B 7/02

[52] U.S. Cl. ..... 187/406; 187/244

[58] Field of Search ..... 187/406, 239, 187/240, 244, 407, 408; 104/127, 128, 129; 414/277, 278, 279, 280, 281, 282, 283

[56] References Cited

U.S. PATENT DOCUMENTS 5,284,226 2/1994 Makimura et al. ..... 187/408

5,355,976 10/1994 Goto et al. ..... 187/406

FOREIGN PATENT DOCUMENTS 1112269 8/1961 Germany .
2606074 8/1977 Germany .
3839091 5/1990 Germany .

OTHER PUBLICATIONS

"Maschinen–elemente", G. Niemann, pp. 205–206; Springer–Verlag, 1981.

*Primary Examiner*—William E. Terrell
*Assistant Examiner*—Dean A. Reichard
*Attorney, Agent, or Firm*—Cohen, Pontani, Lieberman, Pavane

[57] ABSTRACT

A supporting and guiding arrangement, in particular a post for shelf storage and retrieval devices, having a box-like section bar with a hollow box cross section. Grooves for guide rails are formed at least in two opposite corners of the hollow box cross section, and the ends of the guide rails are fixed in a holder.

13 Claims, 3 Drawing Sheets

SUPPORTING AND GUIDING ARRANGEMENT, IN PARTICULAR A POST FOR SHELF STORAGE AND RETRIEVAL DEVICES

BACKGROUND OF THE INVENTION

1. Field of the Invention

The invention is directed to a supporting and guiding arrangement having a box-like section bar, in particular a post for shelf storage and retrieval devices.

2. Discussion of the Prior Art

It is known from DE-26 06 074 C2 to form a metal post of lengthwise chords and bracing members for shelf storage and retrieval vehicles to serve as a guide and support for a lifting platform. This produces a very heavy box section with inner box walls and solid connecting webs.

It is also known to produce braced posts from sections. Furthermore, it is known to make square-pipe posts by folding together extruded plates. Posts can also be assembled from X-sections.

The disadvantage in all of these suggestions is the great weight of the supporting and guiding arrangement. A further disadvantageous characteristic is the relatively low bending strength in spite of high concentrations of material within the cross section.

The known heavy posts having a length (height) of more than 6 m are also subject to substantial deflection which brings about unwanted vibrations.

SUMMARY OF THE INVENTION

Accordingly, it is an object of the present invention to provide a lightweight construction of a supporting and guiding arrangement in order to reduce the moving mass and at the same time to provide a basis for steps for damping vibrations.

Pursuant to this object, and others which will become apparent hereafter, one aspect of the present invention resides in a section bar having a hollow box cross section. Grooves for guide rails are formed at least in two opposite corners of the hollow box cross section, and the ends of the guide rails are fixed in a holder. This results in a lightweight supporting and guiding arrangement with the desired bending strength characteristics. The reduced moving mass in a shelf storage and retrieval device pursuant to the present invention permits greater acceleration values or lower driving forces, for example. The same is true when applied to linear units in handling technology. The concept of an optionally great moment of inertia of the combination of hollow-box cross section and two or more guide rails is advantageous.

In order to reduce deflection under bending loads, a further embodiment of the invention has the guide rails constructed as tie rods that are pretensioned by the holders.

Pursuant to still a further embodiment, the guide rods have threaded ends at the ends of the section bar which serve for fastening a drive housing. Such a construction is particularly favorable with respect to the section corners of the hollow box cross section.

An additional reduction in weight is achieved when the section bar is formed from an extruded light-alloy hollow box section. For example, approved aluminum alloys can be used for this purpose.

In still another embodiment the grooves for round guide rails are half-round grooves. The circular-section guide rails can either be semicircular or extensively closed at the circumference. These two constructions permit the guide rails to be clamped into the grooves so as to be resistant to shear or not resistant to shear.

Vibrations and noise pose persistent problems in posts of the type presently dealt with. In order to damp such noise and vibrations a resiliently damping intermediate layer is inserted between the grooves and the guide rails. The resiliently damping intermediate layer is made of a polyurethane or polyethylene plastic material.

In technical respects relating to manufacture, it is advantageous to coat the section bar with a uniform thickness of the resiliently damping intermediate layer in the grooves or to fit the intermediate layer to the guide rod beforehand as an elastic tube.

Further, depending on the application, the guide rails can be surface-hardened.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
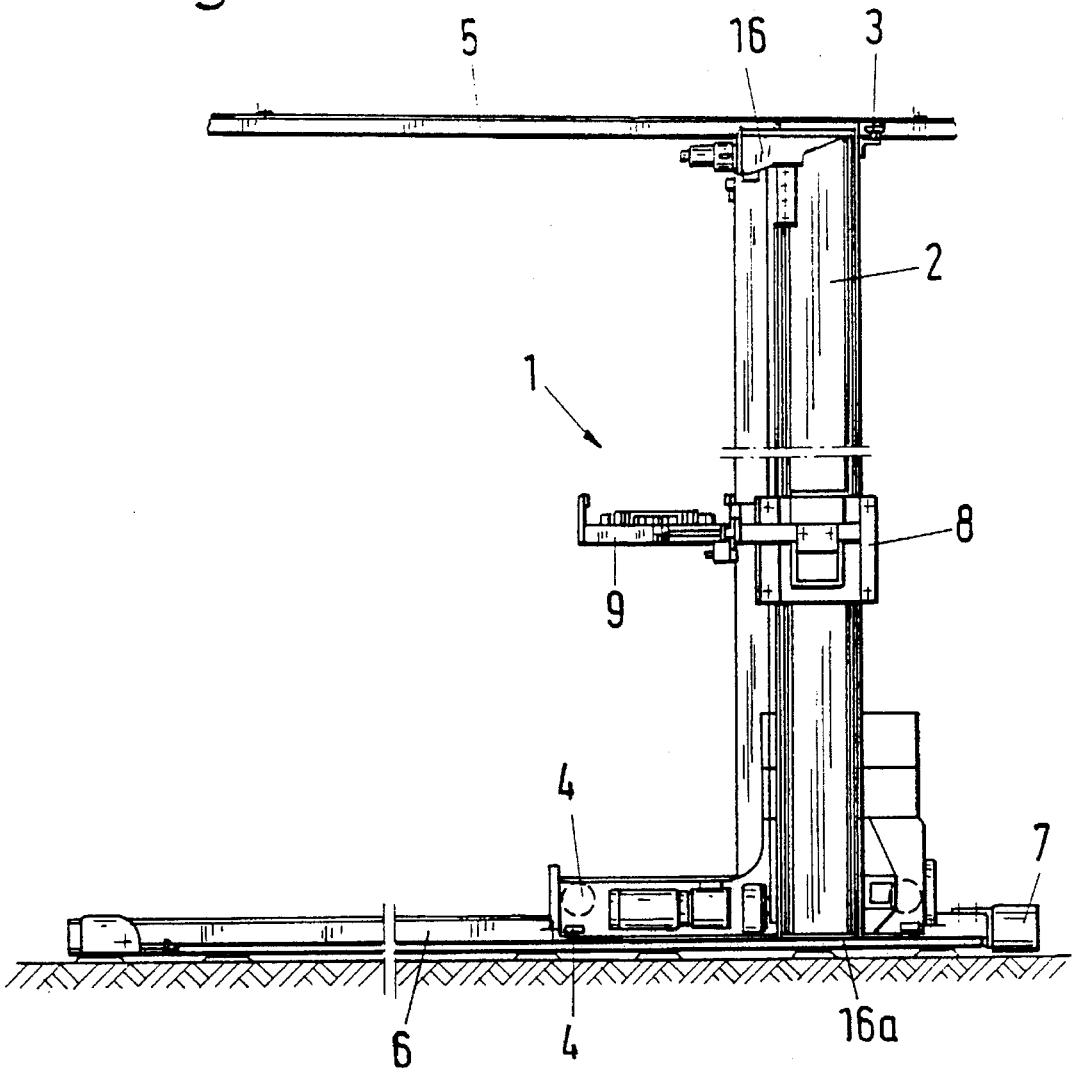
FIG. 1 is a front elevation of a shelf storage and retrieval device pursuant to the present invention.
Figure 2:
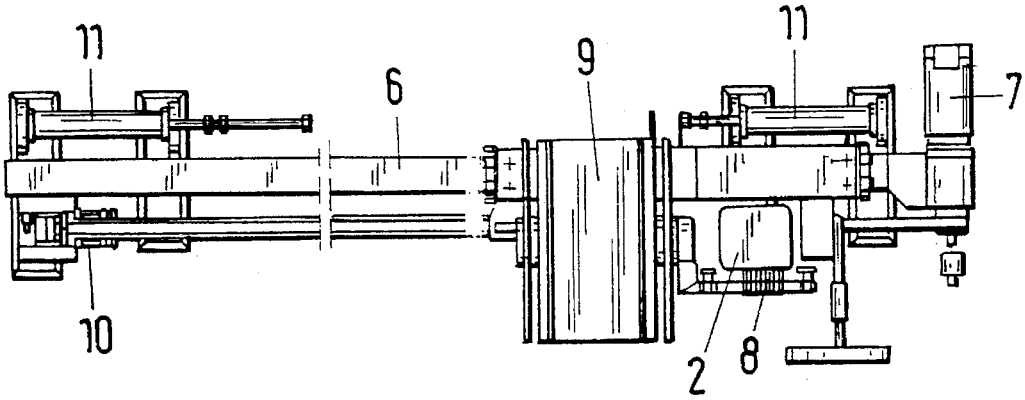
FIG. 2 is a bottom view of the shelf storage and retrieval device according to FIG. 1.
Figure 3:
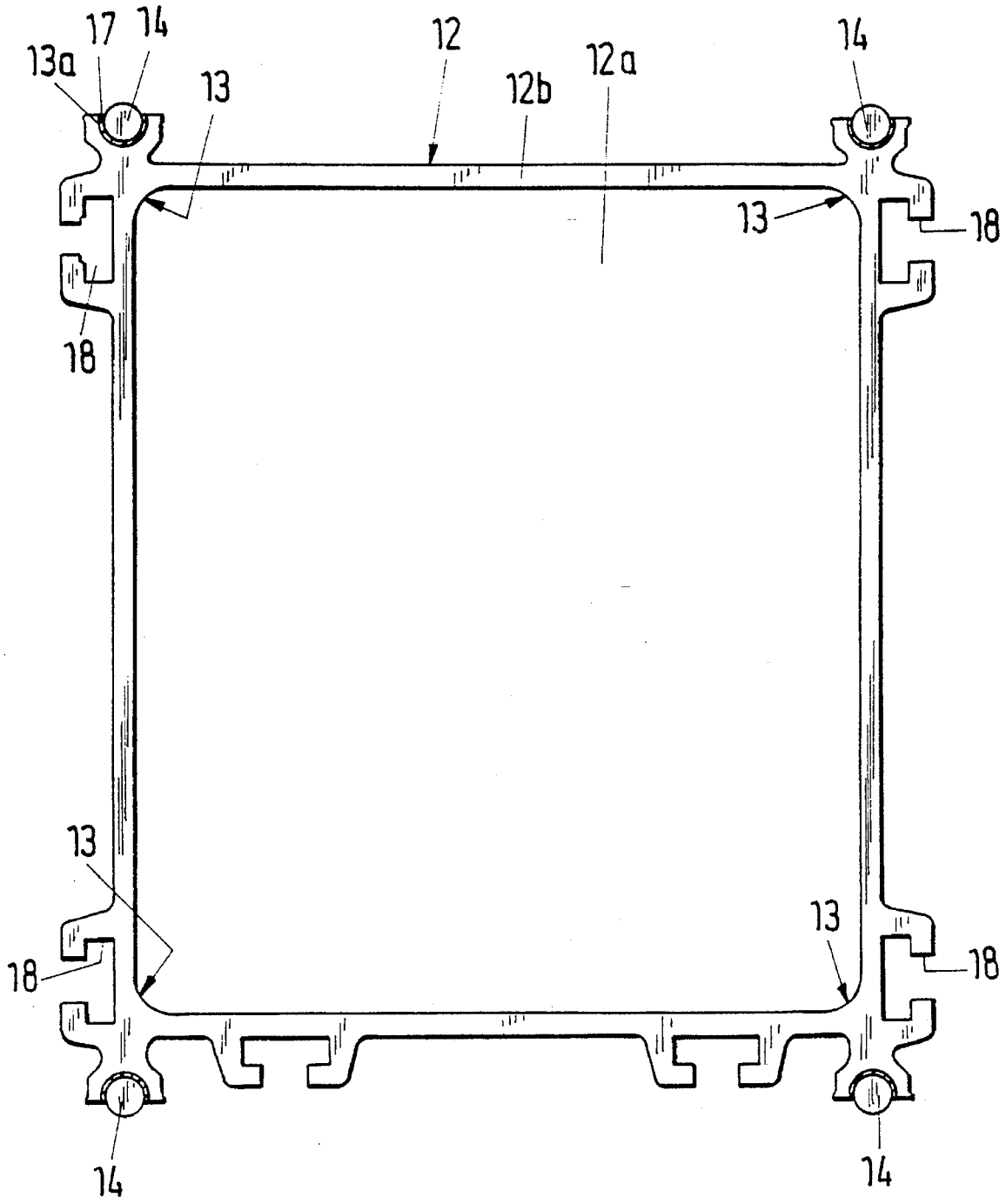
FIG. 3 shows a cross section through the post of the shelf storage and retrieval device.
Figure 4:
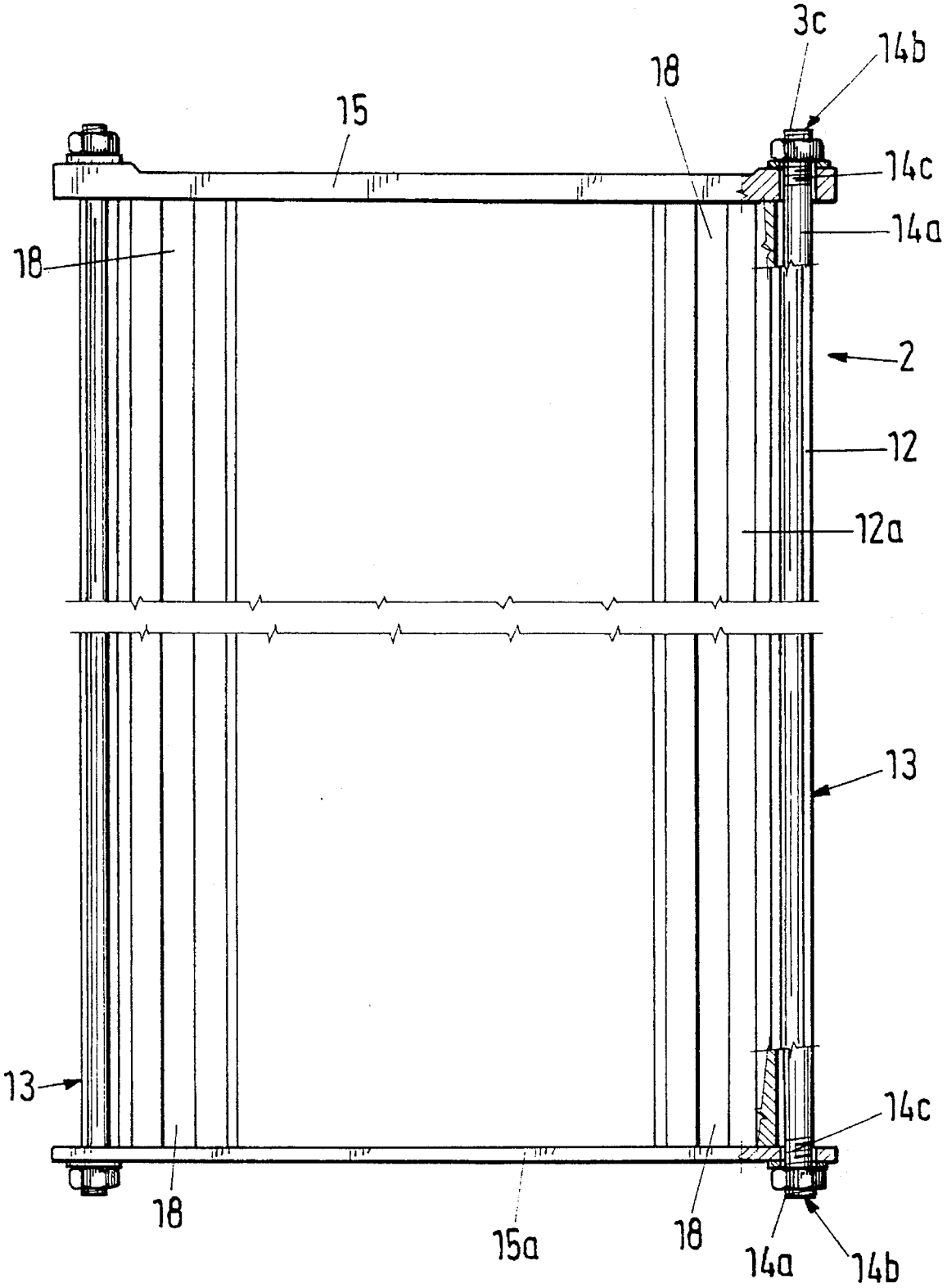
FIG. 4 shows the post with fastened rail ends.

A post for a shelf storage and retrieval device 1 is shown in FIGS. 1 and 2 as an embodiment of a supporting and guiding arrangement. The actual post 2 is movably arranged at or connected to an upper guide 5 and on a lower guide 6 located on the floor by means of pairs of rollers 3 and 4, respectively. A drive 7 is provided for moving the post 2. A driven lifting device 8 is provided so that it can be raised and lowered at the post 2. The lifting device 8 supports load-carrying means 9. The shelf storage and retrieval device can be moved around a deflecting station 10 by means of revolving traction means or horizontally by means of a friction wheel, without limiting the idea according to the present invention. Further, hydraulic buffers 11 are located in the regions of the end positions of the post 2.

The actual supporting and guiding arrangement is formed by the post 2 which has a box-like section bar 12 having a hollow box cross section 12*a*. Grooves 13*a* are arranged in at least two opposite corners 13 of the hollow box cross section 12*a*. Guide rails 14, whose ends 14*a* are fixed in an upper holder 15 and a lower holder 15*a*, are arranged to run in the grooves 13*a* .

The guide rails 14 are constructed as tie rods and are pretensioned by the upper and lower holders 15 and 15*a* so as to impart compressive stress to the section bar 12. Threaded rods 14*c* are located at each end 14*b* of the section bar 12 for the purpose of tightening an upper drive housing 16 and/or a lower drive housing 16*a* in order to apply pretensioning.

The section bar 12 can have a particularly light, but tough extruded light-metal hollow box section 12*b*. The grooves 13*a* for round guide rails 14 (with circular cross section) are semicircular grooves. A resiliently damping intermediate layer 17 of polyurethane or polyethylene is inserted between the grooves 13*a* and the guide rails 14. This intermediate layer 17 can be applied in uniform thickness either to the inner surface of the groove 13*a* or to the guide rail 14 itself in a fixed manner. It is also possible to fit the intermediate layer 17 to the guide rail 14 beforehand as a tube and to glue this pre-joined part into the groove 13*a*. The entire post 2 is provided at its outer circumferential sides with fastening grooves 18 to which other units can be attached. These same fastening grooves 18 can also be used, under other circumstances, for fastening the post itself.

The invention is not limited by the embodiments described above which are presented as examples only but can be modified in various ways within the scope of protection defined by the appended patent claims.

What is claimed is:

1. A supporting and guiding arrangement for a shelf storage and retrieval device, comprising: a post having a box-like section bar with a hollow box cross section, grooves being formed at least in two opposite corners of the hollow box cross section; a holder arranged at each end of the section bar; and guide rails arranged in the grooves and having ends fixed to each holder.

2. An arrangement according to claim 1, wherein the guide rails are tie rods arranged so as to be pretensioned by the holders and the section bar.

3. An arrangement according to claim 1, and further comprising threaded rods arranged at each end of the section bar, and a pair of drive housings, the drive housings being respectively connected to the threaded rods at respective ends of the section bar.

4. An arrangement according to claim 1, wherein the section bar is an extruded light-metal hollow box section.

5. An arrangement according to claim 1, wherein the guide rails are round and the grooves are semi-circular.

6. An arrangement according to claim 1, and further comprising a resiliently damping intermediate layer inserted between the grooves and the guide rails.

7. An arrangement according to claim 5, and further comprising a resiliently damping intermediate layer inserted between the grooves and the guide rails.

8. An arrangement according to claim 6, wherein the resiliently damping intermediate layer is made of one of a polyurethane and a polyethylene plastic.

9. An arrangement according to claim 7, wherein the resiliently damping intermediate layer is made of one of a polyurethane and a polyethylene plastic.

10. An arrangement according to claim 6, wherein the resiliently damping intermediate layer is a coating of uniform thickness in the grooves of the section bar.

11. An arrangement according to claim 7, wherein the resiliently damping intermediate layer is a coating of uniform thickness in the grooves of the section bar.

12. An arrangement according to claim 1, wherein the guide rails are surface-hardened.

13. An arrangement according to claim 6, wherein the resiliently damping intermediate layer is a plastic robe fitted to the guide rails and glued into the grooves.

* * * * *